US009623676B2

(12) United States Patent
Sasaki

(10) Patent No.: US 9,623,676 B2
(45) Date of Patent: Apr. 18, 2017

(54) MEDIUM DRYING DEVICE, MEDIUM DRYING METHOD, RECORDING APPARATUS, AND VAPOR REMOVING DEVICE

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/957,371

(22) Filed: Dec. 2, 2015

(65) Prior Publication Data

US 2016/0159111 A1 Jun. 9, 2016

(30) Foreign Application Priority Data

Dec. 4, 2014 (JP) ..... 2014-245770

(51) Int. Cl.
*B41J 11/00* (2006.01)

(52) U.S. Cl.
CPC ..... *B41J 11/002* (2013.01)

(58) Field of Classification Search
CPC ..... B41J 11/0015; B41J 11/002
See application file for complete search history.

(56) References Cited

U.S. PATENT DOCUMENTS

2012/0069110 A1* 3/2012 Nakazawa ..... B41J 11/002 347/102
2012/0098881 A1* 4/2012 Numata ..... B41J 29/377 347/16
2012/0162303 A1* 6/2012 Sasaki ..... B41J 11/002 347/17
2012/0313996 A1* 12/2012 Veis ..... F26B 3/30 347/20
2013/0100218 A1* 4/2013 Iijima ..... B41J 11/002 347/102
2014/0253653 A1 9/2014 Sasaki
2015/0103117 A1 4/2015 Sasaki

FOREIGN PATENT DOCUMENTS

JP 2010-274524 12/2010
JP 2012-086533 5/2012
JP 2014-172285 9/2014
JP 2015-074216 4/2015

* cited by examiner

*Primary Examiner* — Bradley Thies
(74) *Attorney, Agent, or Firm* — Workman Nydegger

(57) ABSTRACT

A medium drying device for drying a medium that is transported, the medium drying device includes a medium drying section that evaporates liquid attached to the medium; a first recovery chamber into which gas containing vapor generated by the evaporation enters; a second recovery chamber into which gas within the first recovery chamber flows; a pressure increasing section that makes the first recovery chamber be in a high pressure state to liquefy vapor by increasing a pressure within the first recovery chamber; a liquid separation section that is provided between the first recovery chamber and the second recovery chamber, and transmits gas to the second recovery chamber after separating liquid generated by the liquefaction; and a blowing section that blows dried gas within the second recovery chamber onto a surface of the medium to which the liquid is attached.

17 Claims, 8 Drawing Sheets

MEDIUM DRYING DEVICE, MEDIUM DRYING METHOD, RECORDING APPARATUS, AND VAPOR REMOVING DEVICE

BACKGROUND

1. Technical Field

The present invention relates to a medium drying device for drying a medium that is transported, a medium drying method, a recording apparatus such as an ink jet type recording apparatus including the medium drying device, and a vapor removing device for removing vapor from gas including vapor.

2. Related Art

In the related art, a recording apparatus including a drying section for drying ink on a recording medium on which recording is performed by ink has been used. For example, a technique in which a liquid component of ink is evaporated by a drying process with respect to the recording medium, vapor generated by the evaporation is heated and compressed, the heated and compressed vapor is ejected onto the recording medium, and then the medium is dried is disclosed in JP-A-2014-172285.

However, since the drying section of the recording apparatus of the related art disclosed in JP-A-2014-172285 is a steam drying mechanism holding humidity, there is room for improvement in terms of promoting drying of the ink ejected onto the recording medium. In addition, for the recording apparatus of the related art disclosed in JP-A-2014-172285, it is not taken into consideration that vapor of the ink component that is evaporated by drying is released into a surrounding environment.

SUMMARY

An advantage of some aspects of the invention is to efficiently drying a medium by accelerating drying of the medium to which liquid such as ink is attached. In addition, another advantage of some aspects of the invention is to effectively reduce release of vapor generated by evaporation of liquid such as ink to a surrounding environment.

According to a first aspect, there is provided a medium drying device for drying a medium that is transported, the medium drying device including a medium drying section that evaporates liquid attached to the medium; a first recovery chamber into which gas containing vapor generated by the evaporation enters; a second recovery chamber into which gas within the first recovery chamber flows; a pressure increasing section that makes the first recovery chamber be in a high pressure state to liquefy vapor by increasing a pressure within the first recovery chamber; a liquid separation section that is provided between the first recovery chamber and the second recovery chamber, and transmits gas to the second recovery chamber after separating liquid generated by the liquefaction; and a blowing section that blows dried gas within the second recovery chamber onto a surface of the medium to which the liquid is attached.

The medium drying device of a second aspect of the invention may further include a gas heating section that heats dried gas of the second recovery chamber.

In the medium drying device of a third aspect of the invention, a medium heating section may also serve as the gas heating section.

In the medium drying device of a fourth aspect of the invention, the medium heating section may be an electromagnetic wave irradiation section that evaporates the liquid by using an electromagnetic wave, and the electromagnetic wave irradiation section may be provided in a position facing a surface of the medium to which the liquid is attached.

In the medium drying device of a fifth aspect of the invention, the medium heating section may be a heat-transfer heating section that heats the medium from a surface of the medium opposite to the surface to which the liquid is attached in a heat transfer manner.

A sixth aspect of the invention is similar to the first aspect, but the medium drying section of the first aspect is eliminated and the gas heating section serves as the medium drying section.

That is, according to the sixth aspect, there is provided a medium drying device for drying a medium that is transported, the medium drying device including a first recovery chamber into which gas containing vapor generated by evaporation of liquid attached to the medium enters; a second recovery chamber into which gas within the first recovery chamber flows; a pressure increasing section that makes the first recovery chamber be in a high pressure state to liquefy vapor by increasing a pressure within the first recovery chamber; a liquid separation section that is provided between the first recovery chamber and the second recovery chamber, and transmits gas to the second recovery chamber after separating liquid generated by the liquefaction; a blowing section that blows dried gas within the second recovery chamber onto a surface of the medium to which the liquid is attached; and a gas heating section that heats dried gas of the second recovery chamber.

In the medium drying device of a seventh aspect of the invention, the gas heating section may be able to adjust a heating temperature.

In the medium drying device of an eighth aspect of the invention, the liquid separation section may include a gas passage section that allows gas within the first recovery chamber to flow into the second recovery chamber while maintaining a high pressure state within the first recovery chamber and leaves the liquid that is liquefied by the high pressure within the first recovery chamber.

In the medium drying device of a ninth aspect of the invention, the pressure increasing section may be constituted by a fan for sucking gas including the vapor and feeding the gas into the first recovery chamber.

In the medium drying device of a tenth aspect of the invention, an inlet of the first recovery chamber may be positioned on an upstream side in a transport direction of the medium, an outlet of the blowing section may be positioned on a downstream side in the transport direction of the medium, and an air curtain forming section may be provided to prevent dried gas released from the outlet of the blowing section from flowing out to the downstream side in the transport direction of the medium.

In the medium drying device of an eleventh aspect of the invention, a wall may be provided on an upstream side from a position in which the air curtain is formed to prevent the dried gas from flowing out to a periphery.

In the medium drying device of a twelfth aspect of the invention, the medium may be supported at a portion in which a heating process is performed with respect to the medium by the medium drying section while inclining at a range of 10° or more and 60° or less with respect to a horizontal plane.

According to a thirteenth aspect of the invention, there is provided a medium drying method for drying a medium that is transported, the medium drying method including recovering gas containing vapor generated by a heating of the medium to which liquid is attached; high-pressurizing for liquefying the vapor by increasing a pressure of gas that is recovered; separating liquid that is liquefied; and blowing dried gas onto a surface of the medium to which the liquid is attached after the liquid is separated.

The medium drying method of a fourteenth aspect of the invention may further include heating dried gas after the liquid is separated.

In the medium drying method of a fifteenth aspect of the invention, gas containing vapor generated by the heating of the medium may become dried gas through the recovering, the high-pressurizing, and the separating, and after the dried gas is blown onto the medium in the blowing, the dried gas may become gas containing the vapor, and then may be subject to the recovering again to circulate.

According to a sixteenth aspect of the invention, there is provided a recording apparatus including a recording head that is able to perform recording on a medium by ejecting aqueous ink that is liquid onto the medium; and a medium drying device that is provided on a downstream side from a recording position of the recording head and performs a drying process with respect to the medium onto which the aqueous ink is ejected, in which the medium drying device is the medium drying device according to any one of the first aspect to the twelfth aspect.

According to a seventeenth aspect of the invention, there is provided a vapor removing device for removing vapor from gas containing the vapor, the vapor removing device including a vapor recovery chamber into which gas containing the vapor enters; a pressure increasing section that makes the vapor recovery chamber be in a high pressure state to liquefy vapor by increasing a pressure within the vapor recovery chamber; and a gas passage section that allows gas within the vapor recovery chamber to flow out to the outside of the chamber while maintaining a high pressure state within the vapor recovery chamber and leaves the liquid that is liquefied by high pressure within the chamber.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
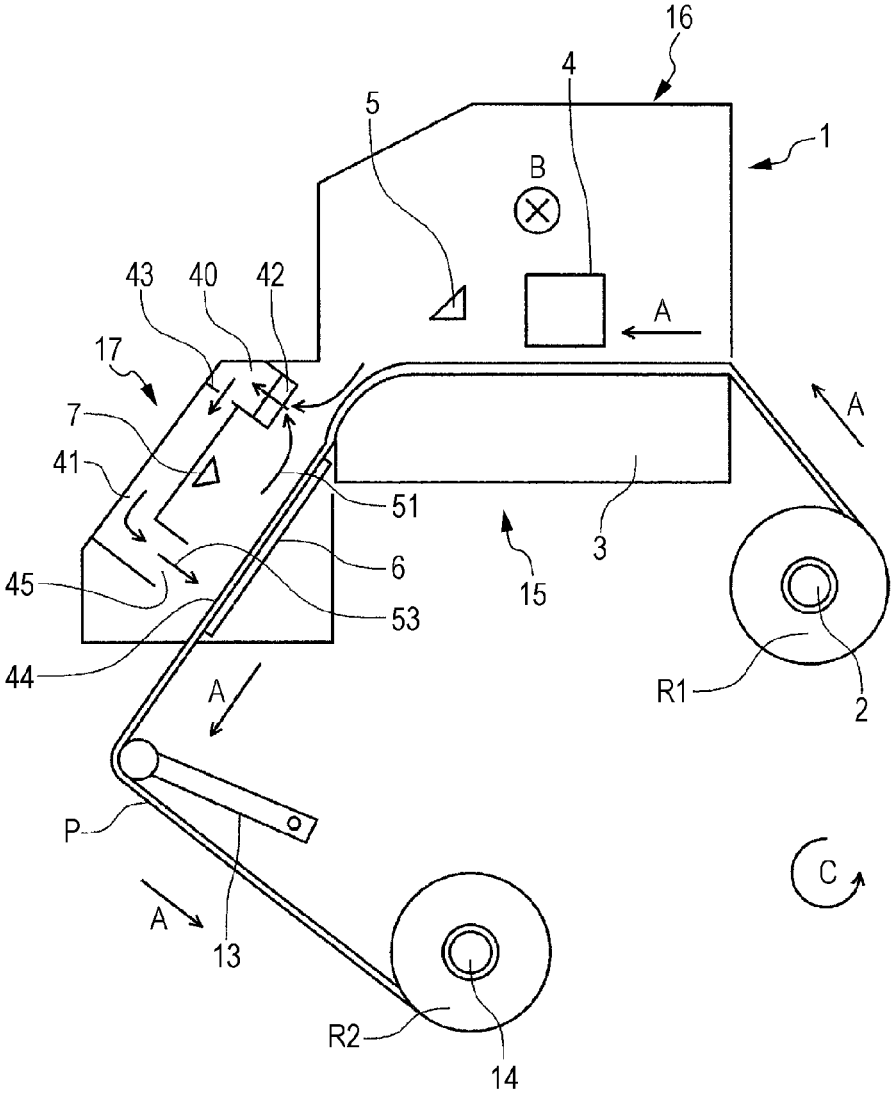
FIG. 1 is a schematic side view illustrating a recording apparatus including a medium drying device according to a first example of the invention.
Figure 2:
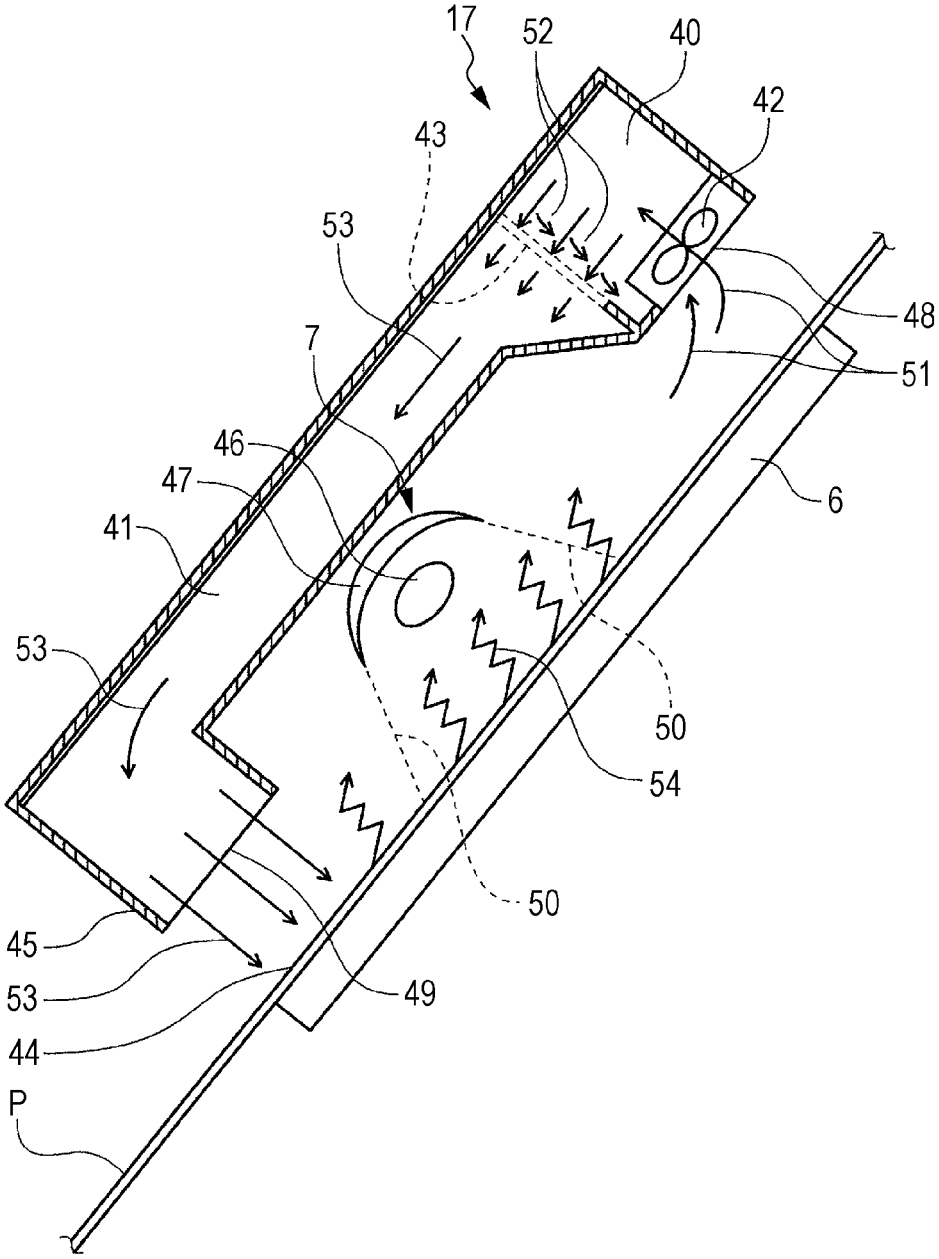
FIG. 2 is a schematic enlarged side view of the medium drying device according to the first example of the invention.
Figure 3:
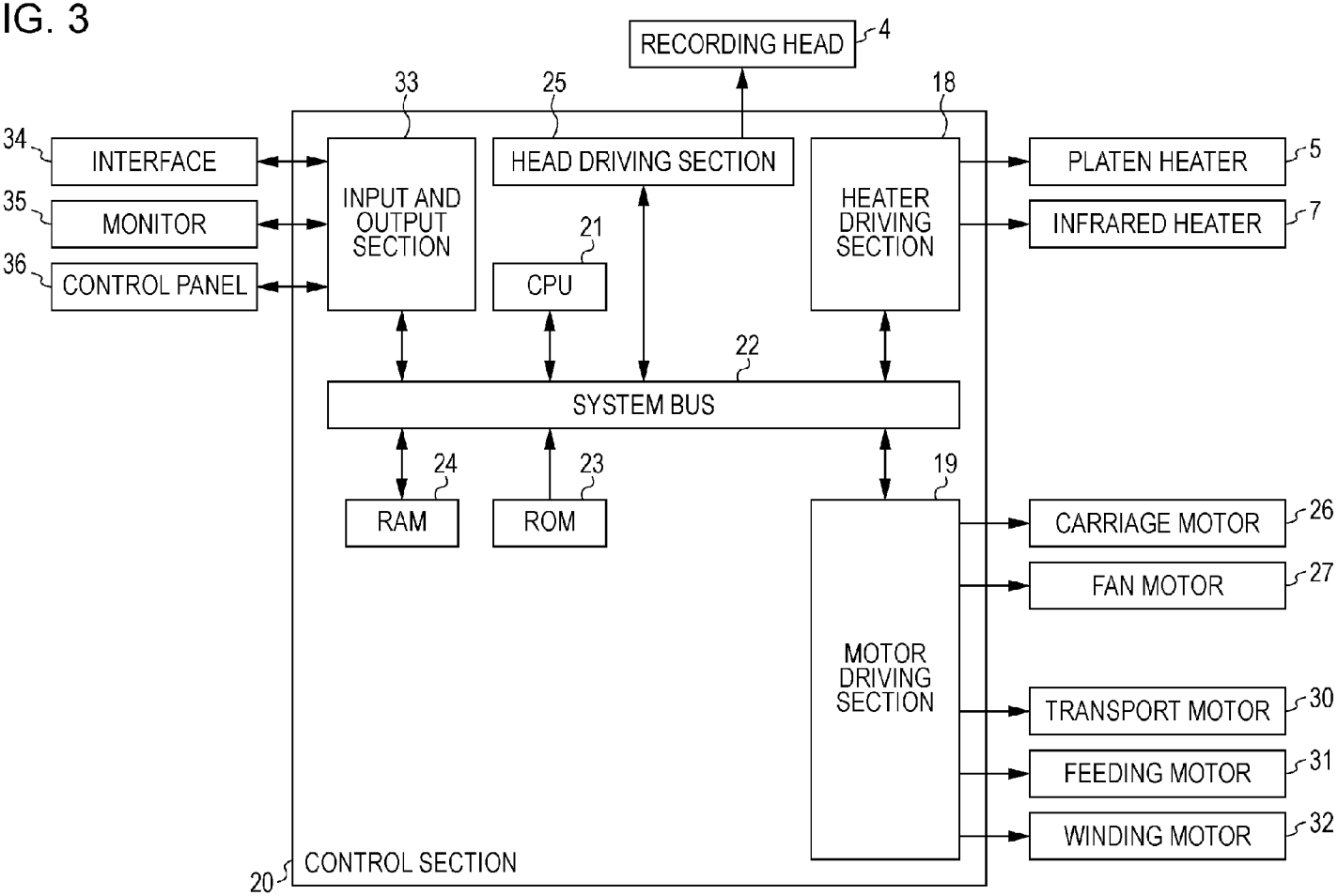
FIG. 3 is a block diagram of the recording apparatus according to the first example of the invention.

Example 1 (FIGS. 1 to 3)

Hereinafter, a recording apparatus including a medium drying device according to an example of the invention will be described with reference to the drawings in detail. First, a recording apparatus according to a first example of the invention will be described. The recording apparatus is an ink jet recording apparatus that is able to record on a recording medium by aqueous ink and including the medium drying device for drying the recording medium onto which ink is ejected.

A recording apparatus 1 of the example includes a set section 2 of a recording medium P which is able to send a roll R1 of the recording medium P for performing recording. Here, as the recording medium P, a roll type recording medium is used, but the invention is not limited to the recording apparatus using such a roll type recording medium.

When the recording apparatus 1 of the example transports the recording medium P in a transport direction A, the set section 2 rotates in a rotation direction C.

Furthermore, the recording apparatus 1 of the example includes a transport mechanism 15 having a plurality of transport rollers (not illustrated) for transporting the roll type recording medium P in the transport direction A. The transport mechanism 15 as a transport section is provided with a platen heater 5 that is able to heat the recording medium P supported by a platen 3.

Moreover, The platen heater 5 of the example is an infrared heater that is provided in a position facing the platen 3 and is able to heat a surface of the recording medium P from 35° C. to 50° C., but is not limited to such a heater and may be a heater that is able to heat the recording medium P from the platen 3 side.

In addition, the recording apparatus 1 of the example includes a recording mechanism 16 for performing recording by a recording head 4 reciprocally scanning the medium in a scanning direction B intersecting the transport direction A of the recording medium P. Furthermore, the recording apparatus 1 of the example includes the recording mechanism 16 for performing recording by the recording head 4 reciprocally scanning the medium, but the recording apparatus 1 may be a recording apparatus including a so-called line head in which a plurality of nozzles ejecting ink are provided in a direction intersecting the transport direction A.

Here, the "line head" is provided such that a region of the nozzles formed in the direction intersecting the transport direction A of the recording medium P is able to cover an entirety of the recording medium P in the intersecting direction. The line head is used in the recording apparatus which forms an image by fixing one of the recording head and the recording medium, and moving the other. Moreover, the region of the nozzles of the line head in the intersecting direction may not be able to cover the entirety of all recording media P to which the recording apparatus corresponds in the intersecting direction. In addition, both the recording head and the recording medium may be movable without fixing one of the recording head and the recording medium.

A medium drying device 17, which is an after-heater for drying the recording medium P transported from the recording head 4 side to a medium supporting section 6, is provided on a downstream side of the transport mechanism 15 and the recording mechanism 16 in the transport direction A of the recording medium P.

The medium drying device 17 includes a medium heating section 7 that evaporates aqueous ink which is liquid attached to the medium P, a first recovery chamber 40 into which gas 51 containing vapor 54 generated by evaporation enters, a second recovery chamber 41 into which gas within the first recovery chamber 40 flows, a pressure increasing section 42 that makes the first recovery chamber 40 be a high pressure state to liquefy the vapor 54 by increasing a pressure within the first recovery chamber 40, a liquid separation section 43 that is provided between the first recovery chamber 40 and the second recovery chamber 41, and transmits gas to the second recovery chamber 41 by separating liquid 52 generated by the liquefaction, and a blowing section 45 that blows dried gas 53 within the second recovery chamber 41 onto a surface 44 of the medium P to which the liquid is attached.

In the example, the medium heating section 7 is constituted by an electromagnetic wave irradiation section 7 (using the same reference numeral) evaporating liquid by using an electromagnetic wave. The electromagnetic wave irradiation section 7 is provided in a position facing the surface 44 of the medium P to which liquid is attached. As the electromagnetic wave irradiation section, specifically, an infrared heater 7 (using the same reference numeral) is used.

As illustrated in FIG. 2, the infrared heater 7 is configured to include an infrared light emitting section 46 and a reflecting section 47. The surface 44 of the medium P is irradiated with substantially entire infrared 50 emitted from the infrared light emitting section 46. Then, the surface 44 that is a surface of the recording medium P is configured to be heated from 60° C. to 120° C. In addition, of course, the medium heating section 7 is not limited to the infrared heater.

In the example, as illustrated in FIG. 1, a region performing a drying process is configured to be an inclined surface. That is, a supporting surface of the medium supporting section 6 that is a portion performing a heating process with respect to the medium P by the medium heating section 7 is configured so as to support the medium P by inclining the medium P with respect to a horizontal plane by a range of 10° or more and 60° or less.

In addition, a structure in which the medium P is horizontally supported without inclining the supporting surface of the medium supporting section 6 may be provided.

In the example, the pressure increasing section 42 is constituted by a fan 42 (using the same reference numeral) feeding the gas 51 into the first recovery chamber 40 by feeding the gas 51 containing the vapor. In the example, the fan 42 is provided in an inlet 48 of the first recovery chamber 40, but may be provided in a position recessed from the inlet 48.

In addition, of course, the pressure increasing section 42 is not limited to the suction fan and another structure such as a structure in which a pressure is increased by a piston and a cylinder can be also used as long as the pressure within the first recovery chamber 40 can be increased.

Here, a "size of the pressure" to liquefy vapor by making the first recovery chamber 40 be in the high pressure state with the pressure increasing section 42 is approximately 30 Pa to 50 Pa.

In the example, the liquid separation section 43 allows gas within the first recovery chamber 40 to flow out within the second recovery chamber 41 while maintaining the high pressure state within the first recovery chamber 40 and includes a gas passage section 43 (using the same reference numeral) leaving the liquid 52 liquefied by the high pressure within the first recovery chamber 40. Gas passing through the gas passage section 43 becomes the dried gas 53.

In addition, even though dried gas, of course, it does not mean dried gas having humidity of zero and in order to significantly achieve drying promotion effect, it is preferable that the humidity is 20% RH or less.

As the gas passage section 43, it is possible to use a filter (non-woven and the like) of which gaps of fibers are air passages and to which liquid is attached, a perforated plate which has a plurality of small holes through which gas passes, and the like.

If the filter such as nonwoven fabric is used as the gas passage section 43, the gas passage section 43 is configured to be regularly replaced. If the perforated plate is used, since the liquid 52 that is liquefied flows down and is accumulated, a tank for receiving the liquid 52 is provided.

In addition, the liquid separation section 43 is not limited to the above structure, allow gas within the first recovery chamber 40 to flow out within the second recovery chamber 41 while maintaining the high pressure state within the first recovery chamber 40, and can be used if the liquid 52 that is liquefied by the high pressure can be left within the first recovery chamber 40.

As illustrated in FIG. 2, the inlet 48 of the first recovery chamber 40 is disposed so as to be positioned on an upstream side from the infrared heater 7 in the transport direction A of the medium P. The blowing section 45 is provided on a downstream side of the second recovery chamber 41 and is disposed so as to be positioned on the downstream side from the infrared heater 7 in the transport direction A. An outlet 49 of the blowing section 45 faces the surface 44 of the medium P to which the liquid is attached.

The gas 51 containing the vapor 54 is sucked into the first recovery chamber 40 by the structure in a position on the upstream side from the infrared heater 7 and the dried gas 53 is blown onto the surface 44 of the medium P to which the liquid is attached on the downstream side from the infrared heater 7. Then, the vapor 54, which is evaporated and rises from the surface 44 by drying by the infrared heater 7 in a heating manner and by drying promotion effect by the dried gas 53, is drawn toward the inlet 48 and is sucked into the chamber by a suction force of the inlet 48 of the first recovery chamber 40. As described above, gas sucked from the inlet of the first recovery chamber 40 is circulation flow and then the drying process of the medium is performed.

Furthermore, a tension adjusting section 13 of a function of adjusting a tension of the recording medium P when winding the recording medium P is provided on the downstream side of the medium drying device 17 in the transport direction A of the recording medium P. Then, a winding section 14 that is able to wind the recording medium P is provided on the downstream side of the tension adjusting section 13 in the transport direction A of the recording medium P. In the recording apparatus 1 of the example, the winding section 14 rotates in the rotation direction C when winding the recording medium P.

Next, an electrical configuration in the recording apparatus 1 of the example will be described.

FIG. 3 is a block diagram of the recording apparatus 1 of the example. The control section 20 is provided with a CPU 21 for controlling an entirety of the recording apparatus 1.

The CPU 21 is connected to a ROM 23 that stores various control programs which are executed by the CPU 21 and a RAM 24 that is able to temporarily store data through the system bus 22. Furthermore, the CPU 21 is connected to a head driving section 25 for driving the recording head 4 through the system bus 22.

Furthermore, the CPU 21 is connected to the platen heater 5 and a heater driving section 18 for driving the infrared heater 7 through the system bus 22.

Furthermore, the CPU 21 is connected to a motor driving section 19 for driving a carriage motor 26, a FAN motor 27, a transport motor 30, a feeding motor 31, and a winding motor 32 through the system bus 22.

Here, the carriage motor 26 is a motor for moving a carriage on which the recording head 4 is mounted. In addition, the FAN motor 27 is a motor for driving a suction fan 42 that is the pressure increasing section. Furthermore, the transport motor 30 is a motor for driving a plurality of transport rollers (not illustrated) provided in the transport mechanism 15. Furthermore, the feeding motor 31 is a rotation mechanism of the set section 2 and a motor driving the set section 2 for feeding the recording medium P to the transport mechanism 15. Then, the winding motor 32 is a driving motor for rotating the winding section 14.

Furthermore, the CPU 21 is connected to a monitor 35 and a control panel 36 which are provided in the recording apparatus 1, an interface 34 for inputting recording data and the like from an external device such as a PC and the like, and an input and output section 33 for transmitting and receiving the data and signals.

Next, a medium drying method by the medium drying device 17 of the first example will be described.

(1) First, the gas 51 containing the vapor 54 generated by heating the medium P to which the liquid is attached by the infrared heater 7 is recovered within the first recovery chamber 40 by suction of the fan 42 (recovering process).

(2) Next, the vapor 54 is liquefied by increasing the pressure of the gas recovered within the first recovery chamber 40 by the fan 42 that is the pressure increasing section (high pressurizing process).

(3) The liquid 52 liquefied by the gas passage section 43 that is the liquid separation section, is left in the first recovery chamber 40, the gas 53 that is dried by separating the liquid 52 passes through the gas passage section 43, and moves to the second recovery chamber 41 (liquid separating process).

(4) The dried gas 53 after separating the liquid is blown onto the surface 44 of the medium P to which the liquid is attached from the blowing section 45 (blowing process).

Next, an operation of the first example will be described.

According to the first example, as described in the medium drying method, the gas 51 containing the vapor 54 generated by heating the medium P to which liquid is attached is recovered within the first recovery chamber 40. Then, the high pressure state is made to liquefy the vapor 54 in the first recovery chamber 40 by increasing the pressure within the first recovery chamber 40 by the pressure increasing section 42. Then, the liquid 52 generated by the liquefaction based on the high pressure state becomes the dried gas 53 by being separated by the liquid separation section 43 and the dried gas 53 flows into the second recovery chamber 41. On the other hand, the liquid 52 leaves in the first recovery chamber 40. Then, the dried gas 53 flowing into the second recovery chamber 41 is blown onto the surface 44 of the medium P to which the liquid is attached by the blowing section 45.

In the liquid attached to the medium P, evaporative drying is efficiently promoted by coming into contact with the dried gas 53 while being evaporated by receiving heat for drying from the medium drying section (infrared heater) 7.

Furthermore, the vapor 54 (vapor having ink component and the like) generated by heating the medium P is separated and removed from the gas that is liquefied. Thus, it is possible to effectively reduce release of the vapor to a surrounding environment.

Heat Damage in Medium Drying

The medium P may be sensitive to heat damage depending on the types of the medium P. A temperature of the medium P during drying the medium P by heating of the medium heating section 7 is often set to be approximately 100° C. to 120° C., but there is a medium that receives heat damage even at a drying temperature of approximately 100° C. or approximately 80° C. that is less than 100° C. If drying is performed by lengthening a drying time by lowering the drying temperature less than 80° C. during drying, it is possible to reduce influence of heat damage, but the medium drying device 17 is increased in size by doing so.

According to the first example, it is possible to lower the temperature during drying by reducing thermal energy for drying supplied from the medium heating section 7 to the medium P by the drying promotion effect by the dried gas 53. That is, it is possible to lower the temperature of the medium P during drying for example, to 60° C. with respect to the medium which receives heat damage at 80° C. by the drying promotion effect of the dried gas 53. Thus, it is possible to efficiently dry even the medium P that is weak in heat damage without increasing the size of the medium drying device 17.

Figure 4:
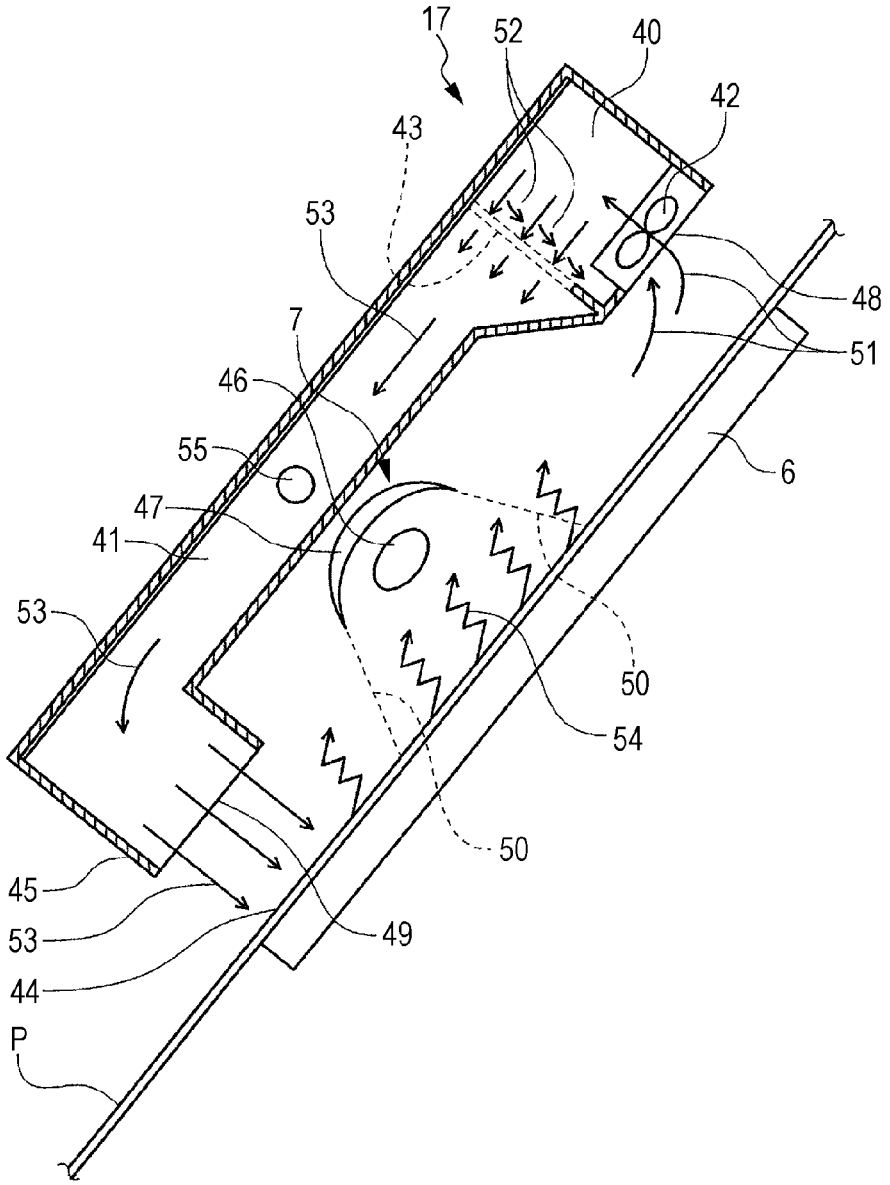
FIG. 4 is a schematic enlarged side view of a medium drying device according to a second example of the invention.

Second Example (FIG. 4)

Next, a medium drying device 17 according to a second example of the invention will be described.

In the second example, a second recovery chamber 41 includes a gas heating section 55 for heating dried gas 53 that is passed. Here, for the gas heating section 55, an electric heater with nichrome wire is used, but the gas heating section 55 is not limited to the electric heater and it is possible to use one as long as it is a heater that is able to heat the dried gas 53 by coming into contact with the passing dried gas 53.

According to the second example, since the gas heating section 55 for heating the dried gas 53 of a second recovery chamber 41 is provided, the dried gas 53 further has the thermal energy by heating by the gas heating section 55 (gas heating process). Thus, it is possible to further promote evaporative drying of liquid attached to the medium P.

It is possible to further reduce the thermal energy supplied from the medium heating section 7 to the medium P and to further lower the temperature of the medium P during drying by replenishment of the thermal energy by the gas heating section 55. That is, it is possible to further reduce influence of heat damage.

In the second example, the gas heating section 55 is configured to adjust the heating temperature. Thus, it is possible to adjust the heating temperature of the dried gas 53 depending on the type of the medium P and environmental conditions such as an ambient temperature and humidity. Thus, it is possible to effectively exert the drying promotion effect.

Figure 5:
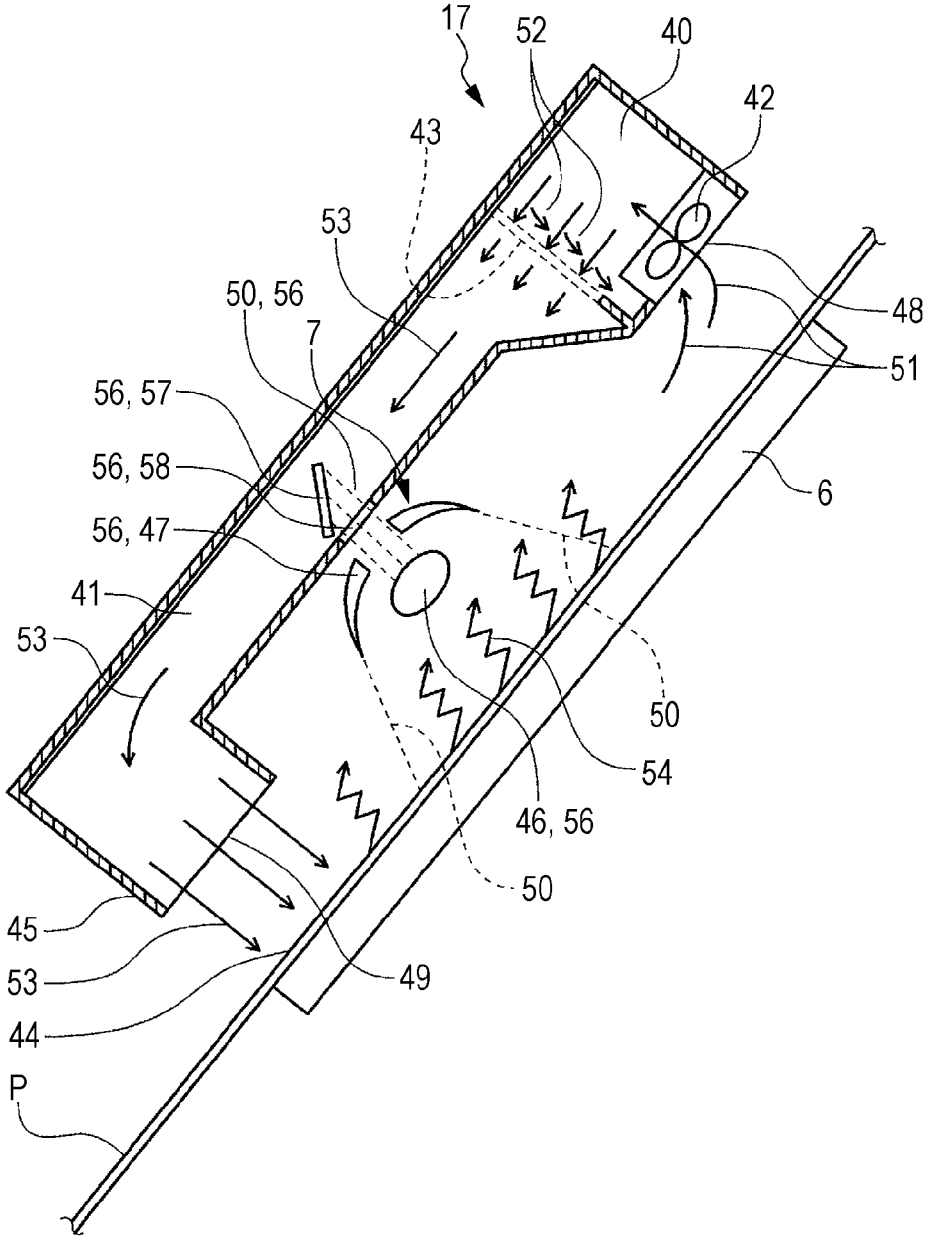
FIG. 5 is a schematic enlarged side view of a medium drying device according to a third example of the invention.

Third Example (FIG. 5)

Next, a medium drying device 17 according to a third example of the invention will be described.

In the third example, a gas heating section 56 also serves as an infrared heater 7 that is the medium heating section.

Specifically, it is configured such that a part of infrared 50 is reflected on an inside of a second recovery chamber 41 by cutting away a part of a reflecting section 47 of the infrared heater 7 without being reflected from an infrared light emitting section 46. A portion of the second recovery chamber 41 on which the infrared is incident is formed by an infrared-permeable plate member 58 and a heating plate 57 receiving the infrared 50 passing through the plate member 58 is provided in a flow path of the dried gas 53. The dried gas 53 is heated by coming into contact with the heating plate 57.

In addition, of course, the combined structure is not limited to the above structure.

According to the third example, since the gas heating section 56 also serves as the infrared heater 7 that is a medium heating section, it is possible to configure the gas heating section 56 by using the infrared heater 7 that is a known medium heating section and to suppress an increase of the number of components.

Figure 6:
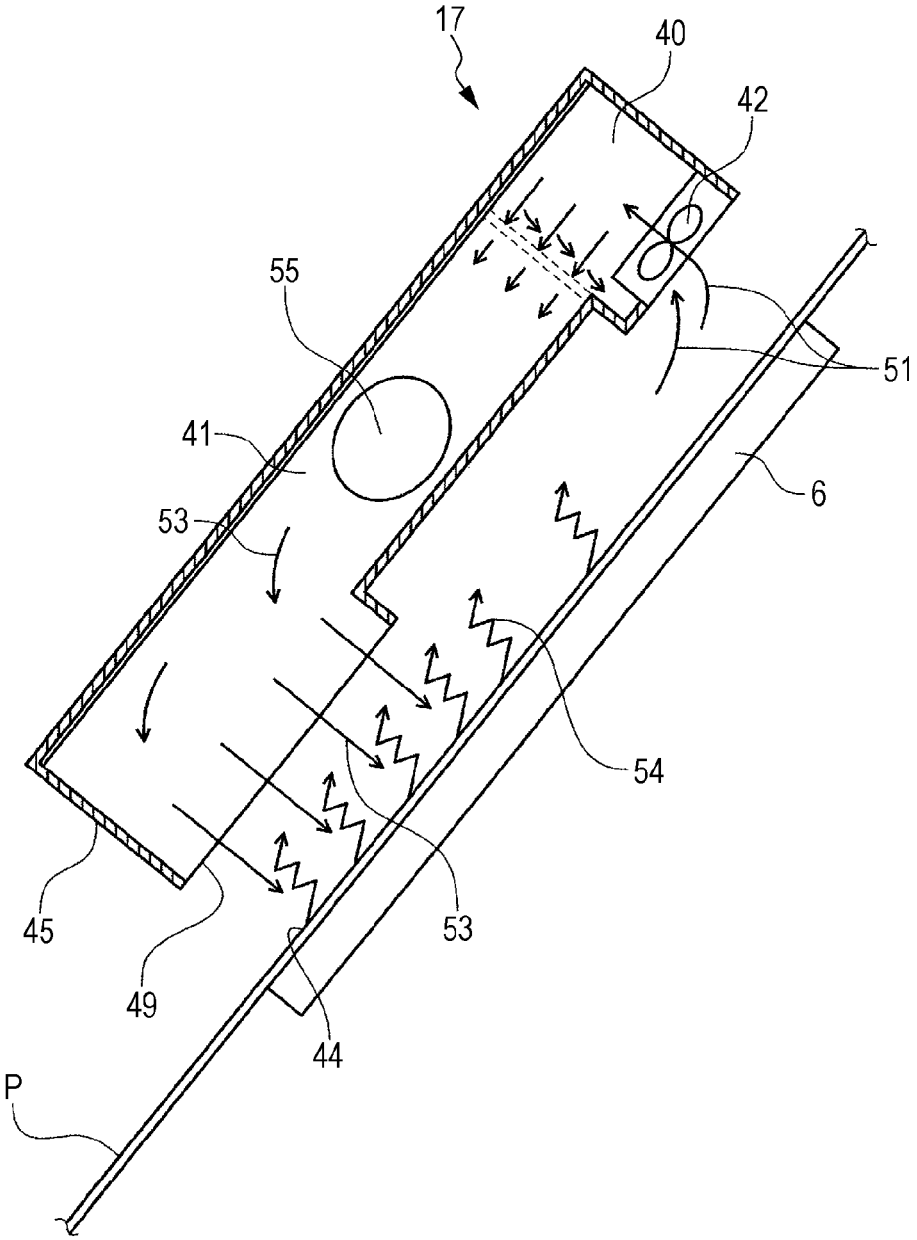
FIG. 6 is a schematic enlarged side view of a medium drying device according to a fourth example of the invention.

Fourth Example (FIG. 6)

Next, a medium drying device 17 according to a fourth example of the invention will be described.

The fourth example is configured such that a gas heating section 55 also serves as a medium drying section without the medium heating section 7 of the first example.

That is, the medium drying device 17 of the fourth example includes a first recovery chamber 40 into which gas 51 containing vapor 54 generated by evaporation of liquid attached to the medium P enters, a second recovery chamber 41 into which gas within the first recovery chamber 40 flows, a pressure increasing section 42 that makes the first recovery chamber 40 be a high pressure state to liquefy the vapor 54 by increasing a pressure within the first recovery chamber 40, a liquid separation section 43 that is provided between the first recovery chamber 40 and the second recovery chamber 41, and transmits gas to the second recovery chamber 41 by separating liquid 52 generated by the liquefaction, a blowing section 45 that blows dried gas 53 within the second recovery chamber 41 onto a surface 44 of the medium P to which the liquid is attached, and a gas heating section 55 that heats the dried gas 53 of the second recovery chamber 41.

An output of the gas heating section 55 is set largely by a control section such that the gas heating section 55 serves as the medium heating section 7 of the first example.

According to the fourth example, the gas heating section 55 also serves as a roll of the medium heating section in the energy output. Thus, it is possible to simultaneously perform heating for drying the medium P and drying promotion by the heated drying gas 53. That is, it is possible to obtain operational effects similar to the first example while preventing an increase in the number of components.

Figure 7:
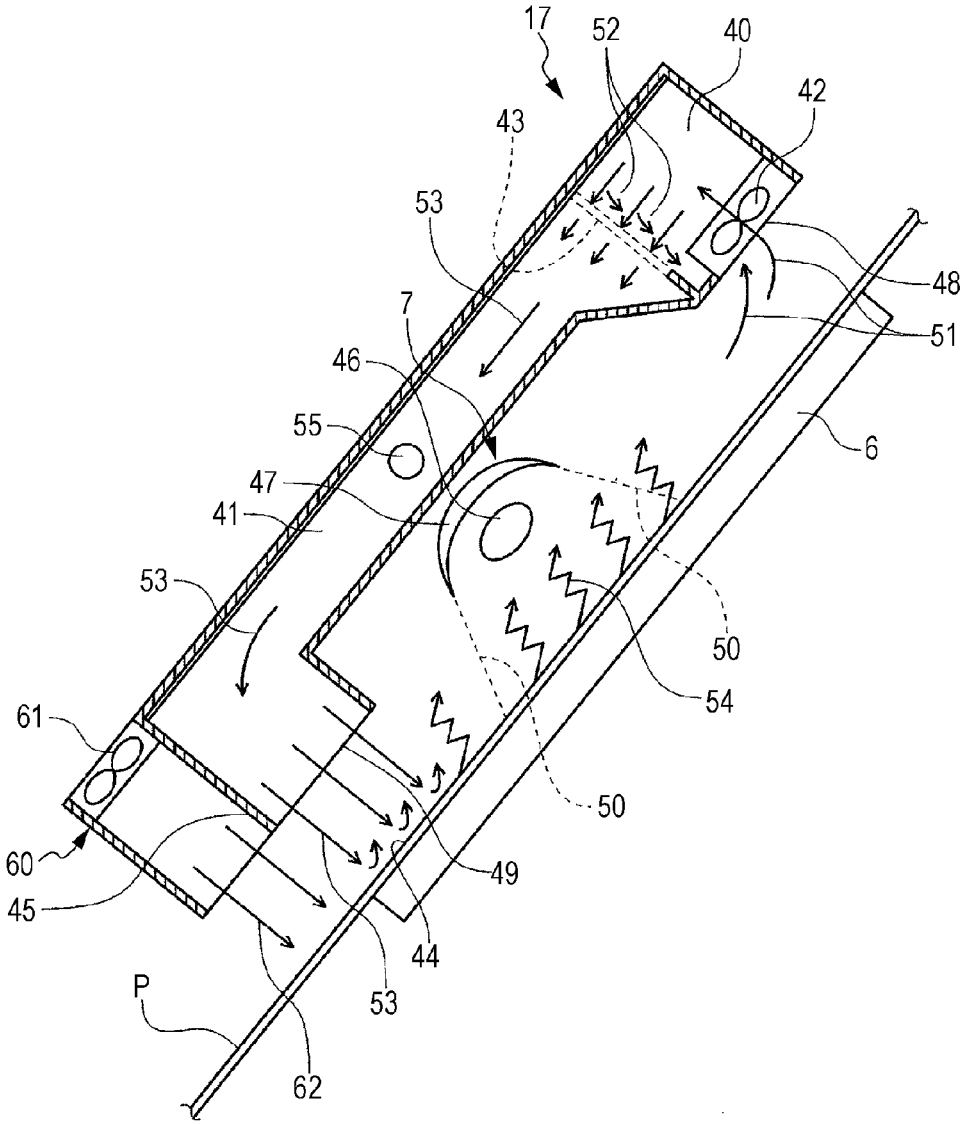
FIG. 7 is a schematic enlarged side view of a medium drying device according to a fifth example of the invention.
Figure 8:
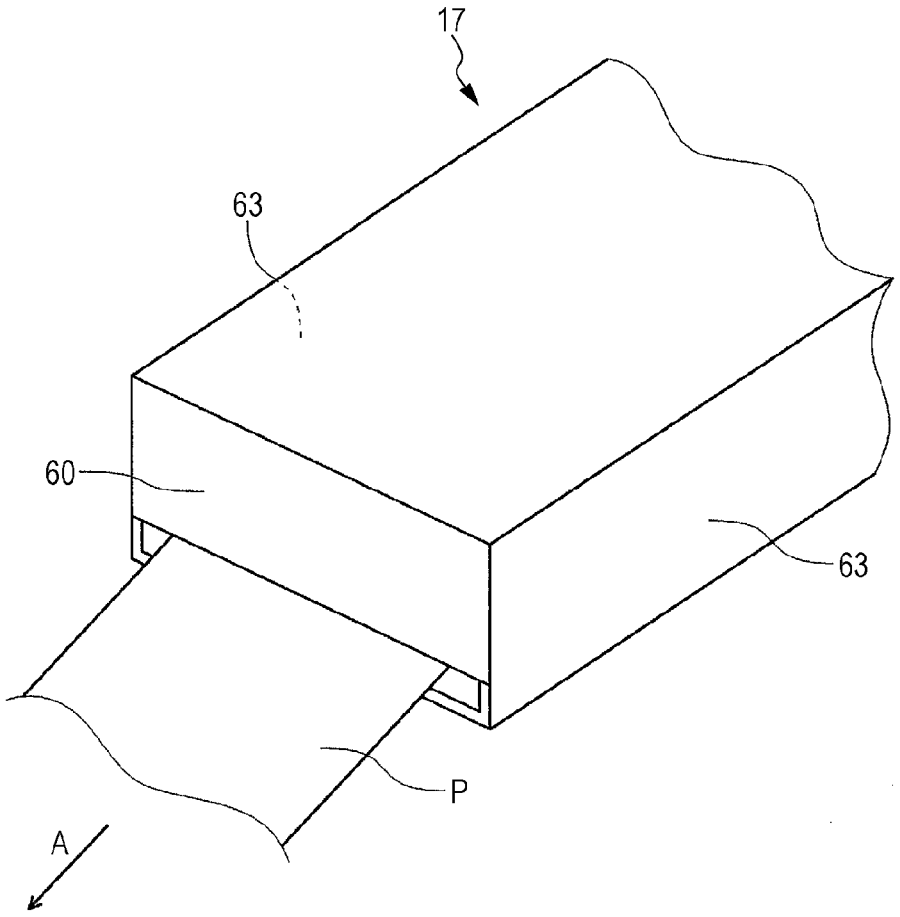
FIG. 8 is a schematic perspective view of a main portion of the medium drying device according to the fifth example of the invention.

Fifth Example (FIGS. 7 and 8)

Next, a medium drying device 17 according to a fifth example of the invention will be described.

In the fifth example, an inlet 48 of a first recovery chamber 40 is positioned on an upstream side in a transport direction A of the medium P, an outlet 49 of the blowing section 45 is positioned on a downstream side in the transport direction A of the medium P, and an air curtain forming section 60 for preventing the dried gas 53 released from the outlet 49 of the blowing section 45 from flowing out on the downstream side in the transport direction A of the medium is provided.

In the example, the air curtain forming section 60 includes a fan 61 and an air curtain 62 is formed by blowing air by the fan 61 onto the surface 44 of the medium P to which the liquid is attached.

According to the fifth example, the dried gas 53 released from the outlet 49 of the blowing section 45 is prevented from flowing out on the downstream side in the transport direction A of the medium by the air curtain 62. Thus, entirely all dried gas 53 can be contributed to the drying promotion without being wasted.

In the fifth example, as indicated by a schematic structure in FIG. 8, a wall 63 preventing the dried gas 53 from flowing out to a periphery is provided on an upstream side from a position in which the air curtain 62 is formed.

As described above, the gas 51 containing the vapor 54 generated by heating the medium P to which liquid is attached is recovered within the first recovery chamber 40. Then, the high pressure state is made by increasing a pressure within the first recovery chamber 40 by the pressure increasing section 42 to liquefy the vapor 54. The liquid 52 generated by liquefaction based on the lips becomes the dried gas 53 by being separated by the liquid separation section 43. The dried gas 53 flows into the second recovery chamber 41 and the liquid on the medium P is blown by the blowing section 45 onto the surface 44 to which the liquid is attached.

In this case, according to the fifth example, the dried gas 53 released from the outlet 49 of the blowing section 45 is prevented from flowing out on the downstream side in the transport direction A of the medium by the air curtain 62. Furthermore, the wall 63 preventing the dried gas 53 from flowing out to the periphery is provided on the upstream side from the position in which the air curtain 62 is formed.

Thus, the gas 51 containing the vapor 54 generated by heating the medium P becomes the dried gas 53 through the liquid separation from the recovery. After the dried gas 53 is blown onto the medium P, the dried gas 53 becomes the gas 51 containing the vapor and is recovered within the first recovery chamber 40 again. That is, the gas 51 containing the vapor repeats liquefaction and separation of the vapor, generation of the dried gas 53, and blowing onto the medium P by being circulation flow. Thus, it is possible to effectively reduce release of the vapor 54 to the surrounding environment.

Other Examples

Circulation Flow by Suction Force of Inlet of First Recovery Chamber

In the medium drying device 17 and the medium drying method described above, even if the air curtain 62 is not formed, the gas 51 containing vapor generated by heating the medium P becomes the dried gas 53 through the liquid separating process from the recovery process by the suction force of the inlet 48 of the first recovery chamber 40 and, after the dried gas 53 is blown onto the medium P by the blowing process, the dried gas 53 becomes the gas 51 containing the vapor 54, is proceeded to the recovery process, and then is circulated. Furthermore, it is possible to further facilitate formation of circulation flow by the blowing section 45 allowing the direction of blowing out of the dried gas 53 to be on a slightly upstream side in the transport direction A.

Each above example is described with respect to the structure in which the medium heating section 7 is provided on the side facing the surface 44 of the medium to which liquid is attached. However, the medium heating section 7 may be a structure including a heat-transfer heating section that heats the medium from a surface opposite to the surface 44 of the medium P to which the liquid is attached in a heat transfer manner. As an example, the heat-transfer heating section is provided within the medium supporting section 6.

According to the example, heat transfer efficiency from the heat-transfer heating section positioned on a rear surface side of the medium P to the medium P is improved by drying promotion effect by the dried gas 53 and it is possible to increase drying efficiency by the heat transfer type heating section.

Furthermore, each above example is described as the medium drying device 17 having the effect of promoting drying by blowing the dried gas 53 onto the medium P. However, in other words, it can be said to include a technical idea of the vapor removing device that removes the vapor from gas containing the vapor.

That is, it can be said to include the vapor removing device that removes the vapor from gas containing the vapor and includes a vapor recovery chamber (first recovery chamber) 40 into which the gas 51 containing the vapor 54 enters, a pressure increasing section 42 that makes the vapor recovery chamber 40 be a high pressure state to liquefy the vapor 54 by increasing a pressure within the vapor recovery chamber 40, and a gas passage section 43 that allows gas within the vapor recovery chamber 40 to flow out to the outside of the chamber while maintaining the high pressure state within the vapor recovery chamber 40 and leaves the liquid 52 liquefied by the high pressure within the chamber.

According to the vapor removing device, it is possible to separate and remove the vapor 54 from the gas 51 such as air containing the vapor 54 by efficiently liquefying the vapor 54 and if gas is released to the atmosphere, it is possible to effectively reduce release of the vapor 54 to the surrounding environment.

In addition, the invention is not limited to the above examples and may be variously modified within the scope of the invention described in the claims, and it needless to say they are also intended to be included within the scope of the invention.

Above, the invention is described in detail based on the specific examples. Here, the invention is described below again as a whole.

According to a first aspect of the invention, there is provided the medium drying device 17 for drying a medium P that is transported, the medium drying device 17 including the medium heating section 7 that evaporates liquid attached to the medium P, the first recovery chamber 40 into which the gas 51 containing the vapor 54 generated by the evaporation enters, the second recovery chamber 41 into which gas within the first recovery chamber 40 flows, the pressure increasing section 42 that makes the first recovery chamber 40 be in the high pressure state to liquefy the vapor 54 by increasing the pressure within the first recovery chamber 40, the liquid separation section 43 that is provided between the first recovery chamber 40 and the second recovery chamber 41, and transmits the gas 53 to the second recovery chamber 41 after separating the liquid 52 generated by the liquefaction, and the blowing section 45 that blows the dried gas 53 within the second recovery chamber 41 onto the surface 44 of the medium P to which the liquid is attached.

According to the aspect, the gas 51 containing the vapor 54 generated by heating the medium P to which liquid is attached is recovered within the first recovery chamber 40. Then, the high pressure state is made to liquefy the vapor 54 in the first recovery chamber 40 by increasing the pressure within the first recovery chamber 40 by the pressure increasing section 42. Then, the liquid 52 generated by the liquefaction based on the high pressure state becomes the dried gas 53 by being separated by the liquid separation section 43 and the dried gas 53 flows into the second recovery chamber 41. On the other hand, the liquid 52 leaves in the first recovery chamber 40. Then, the dried gas 53 flowing into the second recovery chamber 41 is blown onto the surface 44 of the medium P to which the liquid is attached by the blowing section 45.

In the liquid attached to the medium P, evaporative drying is efficiently promoted by coming into contact with the dried gas 53 while being evaporated by receiving heat for drying from the medium heating section 7.

Furthermore, the vapor 54 (vapor having ink component and the like) generated by heating the medium P is separated and removed from the gas that is liquefied. Thus, it is possible to effectively reduce release of the vapor 54 to the surrounding environment.

Furthermore, according to the aspect, it is possible to lower the temperature during drying by reducing thermal energy for drying supplied from the medium heating section 7 to the medium P by the drying promotion effect by the dried gas 53. That is, it is possible to lower the temperature of the medium P during drying for example, to 60° C. with respect to the medium which receives heat damage at 80° C. by the drying promotion effect of the dried gas 53. Thus, it is possible to efficiently dry even the medium that is weak in heat damage without increasing the size of the medium drying device 17.

The medium drying device of a second aspect of the invention further includes the gas heating section 55 for heating the dried gas 53 of the second recovery chamber 41.

According to the aspect, since the gas heating section 55 for heating the dried gas 53 of the second recovery chamber 41 is provided, the dried gas 53 further has the thermal energy and it is possible to further promote evaporative drying of liquid attached to the medium P. It is possible to further reduce the thermal energy supplied from the medium heating section 7 to the medium P and to further lower the temperature of the medium P during drying by replenishment of the thermal energy by the gas heating section 55. That is, it is possible to further reduce influence of heat damage.

In the medium drying device of a third aspect of the invention, the medium heating section 7 also serves as the gas heating section 56.

According to the aspect, since the gas heating section 56 also serves as the infrared heater 7, it is possible to configure the gas heating section 56 by using the known medium heating section 7 and to suppress an increase of the number of components.

In the medium drying device of a fourth aspect of the invention, the medium heating section 7 is the electromagnetic wave irradiation section that evaporates the liquid by using the electromagnetic wave, and the electromagnetic wave irradiation section is provided in the position facing the surface 44 of the medium P to which the liquid is attached.

According to the aspect, since drying is performed by irradiating the surface 44 of the medium P to which liquid is attached with the electromagnetic wave such as the infrared 50, it is possible to heat the medium P while allowing the dried gas 53 to pass through the surface of the medium P being irradiated with the electromagnetic wave 50. Thus, it is possible to effectively obtain drying promotion effect by the dried gas 53.

In the medium drying device of a fifth aspect of the invention, the medium heating section 7 is the heat-transfer heating section that heats the medium from the surface of the medium P opposite to the surface 44 to which the liquid is attached in a heat transfer manner.

According to the aspect, heat transfer efficiency from the heat-transfer heating section to the medium P is improved by drying promotion effect by the dried gas 53 and it is possible to increase the drying efficiency by the heat transfer type heating section.

According to a sixth aspect of the invention, there is provided the medium drying device 17 for drying a medium P that is transported, the medium drying device 17 including the first recovery chamber 40 into which the gas 51 containing the vapor 54 generated by evaporation of liquid attached to the medium P enters, the second recovery chamber 41 into which gas within the first recovery chamber 40 flows, the pressure increasing section 42 that makes the first recovery chamber 40 be in the high pressure state to liquefy the vapor 54 by increasing the pressure within the first recovery chamber 40, the liquid separation section 43 that is provided between the first recovery chamber 40 and the second recovery chamber 41, and transmits the gas 53 to the second recovery chamber 41 after separating liquid 52 generated by the liquefaction, the blowing section 45 that blows the dried gas 53 within the second recovery chamber 41 onto the surface 44 of the medium P to which the liquid is attached, and the gas heating section 55 that heats the dried gas 53 of the second recovery chamber 41.

According to the aspect, the gas heating section 55 also serves as the roll of the medium heating section 7 in the energy output. Thus, it is possible to simultaneously perform heating for drying the medium P and drying promotion by the heated drying gas 53. That is, it is possible to obtain operational effects similar to the first aspect while preventing an increase in the number of components.

In the medium drying device of a seventh aspect of the invention, the gas heating sections 55 and 56 are able to adjust the heating temperature.

According to the aspect, the heating temperature of the dried gas 53 is adjusted depending on the type of the medium P and environmental conditions such as an ambient temperature and humidity. Thus, it is possible to effectively exert the drying promotion effect.

In the medium drying device of an eighth aspect of the invention, the liquid separation section 43 includes the gas passage section 43 that allows gas within the first recovery chamber 40 to flow into the second recovery chamber 41 while maintaining the high pressure state within the first recovery chamber 40 and leaves the liquid 52 that is liquefied by high pressure within the first recovery chamber 40.

According to the aspect, the liquid separation section 43 is configured to include the gas passage section 43 that allows gas within the first recovery chamber 40 to flow out within the second recovery chamber 41 while maintaining the high pressure state within the first recovery chamber 40 and leaves the liquid 52 that is liquefied by the high pressure within the first recovery chamber 40. Thus, it is possible to realize liquefaction of the vapor 54 by the high pressure state and separation of the gas 53 from the liquid 52 that is liquefied with a simple structure.

In the medium drying device of a ninth aspect of the invention, the pressure increasing section 42 is constituted by the fan 42 for sucking the gas 51 containing the vapor 54 and feeding the gas 51 into the first recovery chamber 40.

According to the aspect, it is possible to realize making of the high pressure state to liquefy the vapor 54 by the pressure increasing section 42 by using the suction fan 42 with a simple structure. In addition, it is preferable that the fan 42 is provided at the inlet 48 of the first recovery chamber 40, but may be provided at a position recessed from the inlet 48.

In the medium drying device of a tenth aspect of the invention, the inlet 48 of the first recovery chamber 40 is positioned on the upstream side in the transport direction A of the medium P, the outlet 49 of the blowing section 45 is positioned on the downstream side in the transport direction A of the medium P, and the air curtain forming section 60 is provided to prevent the dried gas 53 released from the outlet 49 of the blowing section 45 from flowing out to the downstream side in the transport direction A of the medium.

According to the aspect, the dried gas 53 released from the outlet 49 of the blowing section 45 is prevented from flowing out on the downstream side in the transport direction A of the medium by the air curtain 62. Thus, entirely all dried gas 53 can be contributed to the drying promotion without being wasted.

In the medium drying device of an eleventh aspect of the invention, the wall 63 is provided on the upstream side from the position in which the air curtain 62 is formed to prevent the dried gas 53 from flowing out to the periphery.

According to the aspect, the dried gas 53 released from the outlet 49 of the blowing section 45 is prevented from flowing out on the downstream side in the transport direction A of the medium by the air curtain 62. The wall 63 preventing the dried gas 53 from flowing out to the periphery is provided on the upstream side from the position in which the air curtain 62 is formed. Thus, the gas 51 containing the vapor 54 generated by heating the medium P becomes the dried gas 53 through the liquid separation from the recovery. After the dried gas 53 is blown onto the medium P, the dried gas 53 becomes the gas 51 containing the vapor 54 and is recovered again. That is, the gas 51 containing the vapor 54 repeats liquefaction and separation of the vapor 54, generation of the dried gas 53, and blowing onto the medium P by being circulation flow. Thus, it is possible to effectively reduce release of the vapor 54 to the surrounding environment.

In the medium drying device of a twelfth aspect of the invention, the medium P is supported at the portion in which the heating process is performed with respect to the medium P by the medium heating section 7 while inclining at the range of 10° or more and 60° or less with respect to the horizontal plane.

The vapor 54 that is generated by the heating process is air rising from the medium P of the inclined state to a vertically upper side. Thus, an area of a horizontal cross section of a region occupied by the rising air with respect to an area of a portion in which the heating process is performed is reduced. According to the aspect, it is possible to reduce a size of the inlet of the first recovery chamber 40 more than that of a horizontally supporting structure that is not inclined. Thus, it is possible to reduce the size thereof.

According to a thirteenth aspect of the invention, there is provided the medium drying method for drying the medium that is transported, the medium drying method including recovering the gas 51 containing the vapor 54 generated by a heating of the medium P to which liquid is attached, high-pressurizing for liquefying the vapor 54 by increasing the pressure of gas that is recovered, separating the liquid 52 that is liquefied, and blowing the dried gas 53 onto the surface 44 of the medium p to which the liquid is attached after the liquid is separated.

According to the aspect, it is possible to obtain the same operational effects as those of the first aspect.

The medium drying method of a fourteenth aspect of the invention further includes heating the dried gas 53 after the liquid is separated.

According to the aspect, it is possible to obtain the same operational effects as those of the second aspect or the sixth aspect.

In the medium drying method of a fifteenth aspect of the invention, the gas 51 containing the vapor 54 generated by the heating of the medium P becomes the dried gas 53 through the recovering, the high-pressurizing, and the separating, and after the dried gas 53 is blown onto the medium P in the blowing, the dried gas 53 becomes the gas 51 containing the vapor 54, and then is subject to the recovering again to circulate.

According to the aspect, the gas 51 containing the vapor 54 repeats liquefy and separation of the vapor 54, generation of the dried gas 53, blowing of the dried gas 53 onto the medium P by being circulation flow. Thus, it is possible to effectively reduce release of the vapor 54 to the surrounding environment.

According to a sixteenth aspect of the invention, there is provided the recording apparatus 1 includes the recording head 4 that is able to perform recording on the medium P by ejecting aqueous ink that is liquid onto the medium P, and the medium drying device 17 that is provided on the downstream side from the recording position of the recording head 4 and performs the drying process with respect to the medium P onto which the aqueous ink is ejected, in which the medium drying device 17 is the medium drying device according to any one of the first aspect to the twelfth aspect.

According to the aspect, it is possible to obtain the same positional effects as each above aspect as the recording apparatus 1 such as the ink jet recording apparatus.

According to a seventeenth aspect of the invention, there is provided the vapor removing device for removing the vapor 54 from the gas 51 containing the vapor 54, the vapor removing device including the vapor recovery chamber 40 into which the gas 51 containing the vapor 54 enters, the pressure increasing section 42 that makes the vapor recovery chamber 40 be in the high pressure state to liquefy the vapor 54 by increasing the pressure within the vapor recovery chamber 40, and the gas passage section 43 that allows gas within the vapor recovery chamber 40 to flow out to the outside of the chamber while maintaining the high pressure state within the vapor recovery chamber 40 and leaves the liquid 52 that is liquefied by high pressure within the chamber.

According to the aspect, it is possible to separate and remove the vapor 54 from the gas 51 such as air containing the vapor 54 by efficiently liquefying the vapor 54. If gas is released to the atmosphere, it is possible to effectively reduce release of the vapor 54 to the surrounding environment.

Aqueous Ink

Next, aqueous ink that is able to be used in the invention will be described.

Aqueous ink that can be used in the invention is suitable for used in the ink jet type recording apparatus 1 of the examples described above. Moreover, it is preferable that water-soluble organic solvent and resin are contained in addition to water as a main solvent, but it is preferable that glycerin is not substantially contained in the water-soluble organic solvent.

Aqueous ink used in the recording apparatus 1 described above is substantially free of glycerin of which a boiling point is 290° C. under 1 atmosphere. If the ink substantially contains glycerin, drying of the ink is reduced significantly. As a result, in various recording media P, particularly, in non-ink absorbing or low-ink absorbing recording medium P, not only density unevenness of an image is noticeable but also fixability of ink is not obtained. Furthermore, it is preferable that alkyl polyols (except glycerin described above) of which a boiling point is 280° C. or more equivalent under 1 atmosphere is not substantially contained.

Here, in this specification, "substantially not contained" means that it contains no more than an amount to fully exhibit significance of adding. This is spoken quantitatively, it is preferable that glycerin is contained no more than 1.0% by mass, it is more preferable that glycerin is contained no more than 0.5% by mass, it is still more preferable that glycerin is contained no more than 0.1% by mass, it is still more preferable that glycerin is contained no more than 0.05% by mass, it is particularly preferable that glycerin is contained no more than 0.01% by mass, and it is most preferable that glycerin is contained no more than 0.001% by mass with respect to a total mass (100% by mass) of ink.

Hereinafter, additives (components) that are contained or may be contained in aqueous ink that is able to be used in the invention will be described.

1. Color Material

Aqueous ink that is able to be used in the invention may contain color materials. The color materials are selected from pigments and dyes.

1-1. Pigment

It is possible to improve light resistance of ink by using pigment as the color material. The pigment may be any of inorganic pigment and organic pigment.

The inorganic pigment is not particularly limited and, for example, carbon black, iron oxide, titanium oxide, and silica oxide are included.

The organic pigment is not particularly limited and, for example, quinacridone based pigment, quinacridonequinone based pigment, dioxazine based pigment, phthalocyanine based pigment, anthrapyrimidine based pigment, anthanthrone based pigment, indanthrone based pigment, flavanthrone based pigment, perylene based pigment, diketopyrrolopyrrole based pigment, perinone based pigment, quinophthalone based pigment, anthraquinone based pigment, thioindigo based pigment, benzimidazolone based pigment, isoindolinone based pigment, azomethine based pigment, and azo based pigment are included. Specific examples of the organic pigments are as follows.

As the pigments used for cyan ink, C.I. Pigment Blue 1, 2, 3, 15, 15:1, 15:2, 15:3, 15:4, 15:6, 15:34, 16, 18, 22, 60, 65, and 66, and C.I. Bat Blue 4, and 60 are included. Among them, it is preferable that at least one of C.I. Pigment Blue 15:3 and 15:4 is provided.

As the pigments used for magenta ink, C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, and C.I. Pigment Violet 19, 23, 32, 33, 36, 38, 43, and 50 are included. Among them, it is preferable that one type or more selected from groups consisting of C.I. Pigment Red 122, C.I. Pigment Red 202, and C.I. Pigment Violet 19 is contained.

As the pigments used for yellow ink, C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213 are included. Among them, it is preferable that one type or more selected from groups consisting of C.I. Pigment Yellow 74, 155, and 213 is contained.

Moreover, as the pigments used for colors other than the above colors such as green ink and orange ink, pigments that are known in the related art are included.

Since clogging in a nozzle can be suppressed and in order to more satisfactorily make ejection stability, it is preferable that an average particle diameter of the pigment is 250 nm or less. In addition, in this specification, the average particle diameter is based on volume. As a measuring method, for example, measurement can be performed by a particle size distribution measurement device using a laser diffraction scattering method as a measurement principle. As the particle size distribution measurement device, for example, a particle size distribution meter (for example, Micro Track UPA made by Nikkiso Co., Ltd.) using a dynamic light scattering method as the measurement principle is included.

1-2. Dye

Furthermore, aqueous ink that is able to use in the invention can use a dye as the color material. As the dye, it is not particularly limited and acid dyes, direct dyes, reactive dyes, and basic dyes are available.

It is preferable that a content of the color material is 0.4% by mass or more and 12% by mass or less and it is more preferable that the content of the color material is 2% by mass or more and 5% by mass or less with respect to a total mass (100% by mass) of ink.

2. Resin

Aqueous ink that is able to be used in the invention may contain resin. Ink contains resin so that a resin film is formed on the recording medium P, as a result, ink is sufficient fixed to the recording medium P, and an effect of improving abrasion resistance of a recorded image is mainly exerted. Thus, it is preferable that resin emulsion is thermoplastic resin.

It is preferable that a thermal deformation temperature of the resin is 40° C. or more because beneficial effects that clogging of the head is unlikely to occur and the friction resistance of a recorded matter is provided. It is more preferable that the thermal deformation temperature of the resin is 60° C. or more.

Here, the "thermal deformation temperature" described above is a temperature value that is indicated by a glass transition (Tg) or a minimum film forming temperature (MFT). That is, the "thermal deformation temperature being 40° C. or more" means that one of the Tg or the MFT is 40° C. or more. Moreover, since relative merits of re-dispersibility of the resin are easily grasped in the MFT more than the Tg, it is preferable that the thermal deformation temperature is the temperature value indicated by the MFT. If it is ink having excellent re-dispersibility of the resin, since ink is not fixed, clogging of the head 31 is unlikely to occur.

In this specification, the Tg is described in a value measured by a differential scanning calorimetry. Furthermore, in this specification, the MFT is described in a value measured by ISO 2115: 1996 (title: measurement of plastic-polymer dispersion-white point temperature and film formation minimum temperature).

The thermoplastic resin is not particularly limited and as specific examples, poly (meth) acrylic acid ester or copolymers thereof, polyacrylonitrile or copolymers thereof, polycyanoacrylate, polyacrylamide, and (meth) acrylic polymer such as poly (meth) acrylic acid, polyethylene, polypropylene, polybutene, polyisobutylene, and polystyrene, and copolymers thereof, and petroleum resin, coumarone-indene resin, and polyolefin-based polymers such as terpene resin, polyvinyl acetate or copolymers thereof, polyvinyl alcohol, polyvinyl acetal, and vinyl acetate-based or vinyl alcohol-based polymer such as polyvinyl ether, polyvinyl chloride or copolymers thereof, polyvinylidene chloride, fluoro resins, and halogen-containing polymer such as fluorine rubber, polyvinyl carbazole, polyvinyl pyrrolidone or copolymers thereof, polyvinyl pyridine, and nitrogen-containing vinyl-based polymers such as polyvinyl imidazole, polybutadiene or copolymers thereof, polychloroprene, and diene-based polymers such as polyisoprene (butyl rubber), and other ring-opening polymerization type resin, condensation polymerized resin, and natural polymer resin are included.

It is preferable that the content of the resin is 1% by mass or more and 30% by mass or less, and it is more preferable that the content of the resin is 1% by mass or more and 5% by mass or less with respect to the total mass (100% by mass) of ink. If the content is within the range described above, it is possible to further improve gloss and abrasion resistance of an overcoat image that is formed.

In addition, as resin that may be contained in the ink, for example, resin dispersant, resin emulsion, wax, and the like are included.

2-1. Resin Emulsion

Aqueous ink that is able to be used in the invention may contain resin emulsion. Resin emulsion exerts an effect to facilitate friction resistance of the image by sufficiently fixing ink to the recording medium by forming resin coating preferably together with wax (emulsion) when the recording medium is heated. The recorded matter that is recorded by using ink containing resin emulsion is excellent in the friction resistance on the recording medium particularly having non-ink absorbing property or low-ink-absorbing property by the effects described above.

Furthermore, resin emulsion that functions as a binder is contained in an emulsion state in the ink. Viscosity of the ink can be easily adjusted to an appropriate range in the ink jet recording type and it is excellent in storage stability and ejection stability of the ink by containing resin functioning as the binder in the ink in the emulsion state.

Resin emulsion is not limited to the following examples, but for example, (meth) acrylic acid, (meth) acrylic acid ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, and homopolymers or copolymers of vinylidene chloride, fluoro resin, and natural resin are included. Among them, at least one of (meth) acrylic resin and styrene-(meth) acrylic acid copolymer resin is preferable, at least one of acrylic resin and styrene-acrylic acid copolymer resin is more preferable, and styrene-acrylic acid copolymer resin is still more preferable. Moreover, the copolymer described above may be any one form of random copolymer, block copolymer, alternating copolymer, and graft copolymer.

In order to more satisfactorily make storage stability and ejection stability of the ink, it is preferable that the average particle diameter of resin emulsion is in a range of 5 nm or more and 400 nm or less and it is more preferable that the average particle diameter of resin emulsion is in a range of 20 nm or more and 300 nm or less.

It is preferable that a content of resin emulsion among resin is in a range of 0.5% by mass or more and 7% by mass or less with respect to a total mass (100% by mass) of the ink. If the content is within the range described above, since solid concentration can be lowered, it can be made better ejection stability.

2-2. Wax

Aqueous ink that can be used in the invention may contain wax. Ink contains wax and thereby ink is excellent by fixability on the recording medium of non-absorption and low absorption. Emulsion type wax is preferable among waxes. Wax described above is not limited to following examples, but for example, polyethylene wax, paraffin wax, and polyolefin wax are included, and among them, polyethylene wax described below is preferable.

Moreover, in this specification, "wax" means to dispersing solid wax particles in water by mainly using surface active agent described below.

The ink described above contains polyethylene wax and thereby abrasion resistance of the ink can be excellent.

In order to more satisfactorily make storage stability and ejection stability of the ink, it is preferable that an average particle diameter of polyethylene wax is in a range of 5 nm or more and 400 nm or less, and it is more preferable that the average particle diameter of polyethylene wax is in a range of 50 nm or more and 200 nm or less.

It is preferable that a content (in terms of solid content) of polyethylene wax is independently in a range of 0.1% by mass or more and 3% by mass or less, it is more preferable that the content of polyethylene wax is in a range of 0.3% by mass or more and 3% by mass or less, and it is particularly preferable that the content of polyethylene wax is in a range of 0.3% by mass or more and 1.5% by mass or less with respect to the total mass (100% by mass) of the ink. If the content is within the range described above, the ink can be favorably solidified and fixed, and storage stability and ejection stability of the ink are further excellent even on the recording medium of non-absorption and low absorption.

4. Surface Active Agent

Aqueous ink that can be used in the invention may contain surface active agent. The surface active agent is not limited to the following example, but for example, nonionic surface active agent is included. The nonionic surface active agent has an effect of uniformly spreading the ink on the recording medium. Thus, when performing ink jet recording by using the ink containing the nonionic surface active agent, high-resolution image having substantially no bleeding is obtained. Such a nonionic surface active agent is not limited to the following examples, but for example, Silicon-based, polyoxyethylene alkyl ether-based, polyoxypropylene alkyl ether-based, polycyclic phenyl ether-based, sorbitan derivative, and fluorine-based surface active agent are included, and among them, silicon-based surface active agent is preferable.

In order to more satisfactorily make storage stability and ejection stability of the ink, it is preferable a content of the surface active agent is in a range of 0.1% by mass or more and 3% by mass or less with respect to the total mass (100% by mass) of the ink.

5. Water

Aqueous ink that can be used in the invention contains water. Water is main solvent of the ink and when the recording medium is heated in ink jet recording, water is a component that is mainly evaporated and scattered.

6. Organic Solvent

Aqueous ink that can be used in the invention may contain known volatile water-soluble organic solvent. However, as described above, it is preferable that the ink of the embodiment does not substantially contain glycerin (boiling point is 290° C. under 1 atmosphere) that is a type of organic solvent and does not substantially contain alkyl polyols (except glycerin described above) having a boiling point of 280° C. at equivalent under 1 atmosphere.

7. Other Components

Aqueous ink that can be used in the invention may further contain antiseptic agent, antifungal agent, rust inhibitor, chelating agent, and the like.

Aprotic Polar Solvent

It is preferable that aqueous ink that can be used in the invention contains aprotic polar solvent. In order to solve resin particles described above contained the ink, it is possible to effectively prevent clogging of the nozzles by containing aprotic polar solvent described above when performing ink jet recording. Furthermore, aprotic polar solvent has a property of dissolving the recording medium such as vinyl chloride and improves adhesion to the image.

Aprotic polar solvent is not particularly limited, but it is preferable that aprotic polar solvent of one type or more selected from pyrrolidones, lactones, sulfoxides, imidazolidinones, sulfolanes, urea derivative, dialkylamides, cyclic ethers, and amide ethers is included. Representative examples of pyrrolidones are 2-pyrrolidone, N-methyl-2-pyrrolidone, N-ethyl-2-pyrrolidone, representative examples of lactones are γ-butyrolactone, γ-valerolactone, and ϵ-caprolactone, representative examples of sulfoxides are dimethyl sulfoxide and tetramethylene sulfoxide, a representative example of imidazolidinones is 1,3-dimethyl-2-imidazolidinone, representative examples of sulfolanes are sulfolane and dimethyl sulfolane, representative examples of urea derivative are dimethyl urea and 1,1,3,3-tetramethylurea, representative examples of dialkylamides are dimethyl formamide and dimethyl acetamide, and representative examples of cyclic ethers are 1,4-dioxane and tetrahydrofuran. Among them, pyrrolidones, lactones, sulfoxides, and amide ethers are particularly preferable in the viewpoint of the effects described above. 2-pyrrolidone is most preferable.

It is preferable that a content of aprotic polar solvent described above is in a range of 3% by mass or more and 30% by mass or less, and it is more preferable that the content of aprotic polar solvent is in a range of 8% by mass or more and 20% by mass or less with respect to the total mass (100% by mass) of the ink.

The entire disclosure of Japanese Patent Application No. 2014-245770, filed Dec. 4, 2014 is expressly incorporated by reference herein.

What is claimed is:

1. A medium drying device for drying a medium that is transported, the medium drying device comprising:

a medium drying section that evaporates liquid attached to the medium;

a first recovery chamber into which gas containing vapor generated by the evaporation enters;

a second recovery chamber into which gas within the first recovery chamber flows;

a pressure increasing section that makes the first recovery chamber be in a high pressure state to liquefy vapor by increasing a pressure within the first recovery chamber, the pressure increasing section forming an inlet into the first recovery chamber, the inlet receiving the gas containing vapor from the medium;

a filter that is provided between the first recovery chamber and the second recovery chamber, and transmits gas to the second recovery chamber after separating liquid generated by the liquefaction; and a blowing section that blows dried gas within the second recovery chamber onto a surface of the medium to which the liquid is attached.

2. The medium drying device according to claim 1, further comprising:

a gas heating section that heats dried gas of the second recovery chamber.

3. The medium drying device according to claim 2, wherein a medium heating section also serves as the gas heating section.

4. A recording apparatus comprising:

a recording head that is able to perform recording on a medium by ejecting aqueous ink that is liquid onto the medium; and a medium drying device that is provided on a downstream side from a recording position of the recording head and performs a drying process with respect to the medium onto which the aqueous ink is ejected, wherein the medium drying device is the medium drying device according to claim 3.

5. The medium drying device according to claim 2, wherein the gas heating section is able to adjust a heating temperature.

6. A recording apparatus comprising:

a recording head that is able to perform recording on a medium by ejecting aqueous ink that is liquid onto the medium; and a medium drying device that is provided on a downstream side from a recording position of the recording head and performs a drying process with respect to the medium onto which the aqueous ink is ejected, wherein the medium drying device is the medium drying device according to claim 2.

7. The medium drying device according to claim 1, wherein the medium heating section is an electromagnetic wave irradiation section that evaporates the liquid by using an electromagnetic wave, and wherein the electromagnetic wave irradiation section is provided in a position facing a surface of the medium to which the liquid is attached.

8. A recording apparatus comprising:

a recording head that is able to perform recording on a medium by ejecting aqueous ink that is liquid onto the medium; and a medium drying device that is provided on a downstream side from a recording position of the recording head and performs a drying process with respect to the medium onto which the aqueous ink is ejected, wherein the medium drying device is the medium drying device according to claim 7.

9. The medium drying device according to claim 1, wherein the medium heating section is a heat-transfer heating section that heats the medium from a surface of the medium opposite to the surface to which the liquid is attached in a heat transfer manner.

10. The medium drying device according to claim 1, wherein the liquid separation section includes a gas passage section that allows gas within the first recovery chamber to flow into the second recovery chamber while maintaining a high pressure state within the first recovery chamber and leaves the liquid that is liquefied by high pressure within the first recovery chamber.

11. The medium drying device according to claim 10, wherein the pressure increasing section is constituted by a fan for sucking gas including the vapor and feeding the gas into the first recovery chamber.

12. The medium drying device according to claim 1, wherein an inlet of the first recovery chamber is positioned on an upstream side in a transport direction of the medium, wherein an outlet of the blowing section is positioned on a downstream side in the transport direction of the medium, and wherein an air curtain forming section is provided to prevent dried gas released from the outlet of the blowing section from flowing out to the downstream side in the transport direction of the medium.

13. The medium drying device according to claim 12, wherein a wall is provided on an upstream side from a position in which the air curtain is formed to prevent the dried gas from flowing out to a periphery.

14. The medium drying device according to claim 1, wherein the medium is supported at a portion in which a heating process is performed with respect to the medium by the medium drying section while inclining at a range of 10° or more and 60° or less with respect to a horizontal plane.

15. A recording apparatus comprising:

a recording head that is able to perform recording on a medium by ejecting aqueous ink that is liquid onto the medium; and a medium drying device that is provided on a downstream side from a recording position of the recording head and performs a drying process with respect to the medium onto which the aqueous ink is ejected, wherein the medium drying device is the medium drying device according to claim 1.

16. A medium drying device for drying a medium that is transported, the medium drying device comprising:

a first recovery chamber into which gas containing vapor generated by evaporation of liquid attached to the medium enters;

a second recovery chamber into which gas within the first recovery chamber flows;

a pressure increasing section that makes the first recovery chamber be in a high pressure state to liquefy vapor by increasing a pressure within the first recovery chamber, the pressure increasing section being an inlet to the first recovery chamber;

a filter that is provided between the first recovery chamber and the second recovery chamber, and transmits gas to the second recovery chamber after separating liquid generated by the liquefaction;

a blowing section that blows dried gas within the second recovery chamber onto a surface of the medium to which the liquid is attached; and a gas heating section that heats dried gas of the second recovery chamber.

17. A medium drying device for drying a medium that is transported, the medium drying device comprising:

a medium drying section that evaporates liquid attached to the medium;

a first recovery chamber into which gas containing vapor generated by the evaporation enters;

a second recovery chamber into which gas within the first recovery chamber flows;

a pressure increasing section that makes the first recovery chamber be in a high pressure state to liquefy vapor by increasing a pressure within the first recovery chamber, the pressure increasing section forming an inlet into the first recovery chamber, the inlet receiving the gas containing vapor from the medium;

a perforated pate that is provided between the first recovery chamber and the second recovery chamber, and transmits gas to the second recovery chamber after separating liquid generated by the liquefaction; and a blowing section that blows dried gas within the second recovery chamber onto a surface of the medium to which the liquid is attached.

* * * * *